US008720859B2

(12) United States Patent
Manvel

(10) Patent No.: US 8,720,859 B2
(45) Date of Patent: May 13, 2014

(54) PULL HANDLE

(76) Inventor: Marie Manvel, Marina del Rey, CA (US)

( * ) Notice: Subject to any disclaimer, the term of this patent is extended or adjusted under 35 U.S.C. 154(b) by 578 days.

(21) Appl. No.: 12/424,467

(22) Filed: Apr. 15, 2009

(65) Prior Publication Data

US 2010/0115735 A1 May 13, 2010

Related U.S. Application Data

(60) Provisional application No. 61/114,417, filed on Nov. 13, 2008.

(51) Int. Cl.

| | |
|---|---|
| ***B66F 13/00*** | (2006.01) |
| ***E06B 9/00*** | (2006.01) |
| ***E06B 9/30*** | (2006.01) |
| *E05B 1/00* | (2006.01) |

(52) U.S. Cl.
USPC ..... 254/1; 160/178.1 R; 160/168.1 R

(58) Field of Classification Search
USPC ..... 254/1; 160/178.1, 178.2, 168.1
See application file for complete search history.

(56) References Cited

U.S. PATENT DOCUMENTS

| | | | | | |
|---|---|---|---|---|---|
| 948,109 | A | * | 2/1910 | Harrigan | 174/138 B |
| 1,406,463 | A | | 2/1922 | Kuehner | |
| 1,414,821 | A | | 5/1922 | Kuehner | |
| 1,468,169 | A | | 9/1923 | Rundell | |
| 1,686,297 | A | * | 10/1928 | Trimble | 16/428 |
| 1,730,820 | A | * | 10/1929 | Holden | 16/431 |
| 1,763,850 | A | | 6/1930 | Holden | |
| 1,769,245 | A | * | 7/1930 | Tregoning | 174/138 B |
| 1,894,195 | A | | 1/1933 | Pulver | |
| 1,947,113 | A | | 2/1934 | Russell | |
| 2,173,451 | A | * | 9/1939 | Lorber | 401/6 |
| 2,233,516 | A | * | 3/1941 | Cecil et al. | 16/438 |
| 2,280,969 | A | * | 4/1942 | O'Malley | 160/384 |
| 2,319,147 | A | * | 5/1943 | Mason | 220/752 |
| 2,371,639 | A | * | 3/1945 | Mason | 220/759 |
| 2,398,436 | A | * | 4/1946 | Mason | 220/752 |
| 2,488,309 | A | * | 11/1949 | Mason | 220/759 |
| 2,532,202 | A | | 11/1950 | Steinbachner | |
| 2,540,369 | A | | 2/1951 | Hume | |
| 2,624,457 | A | | 1/1953 | Jablon | |
| 2,654,115 | A | * | 10/1953 | Kafer | 16/421 |

(Continued)

FOREIGN PATENT DOCUMENTS

FR 2767152 A 2/1999

OTHER PUBLICATIONS

International Search Report and Written Opinion dated Jan. 29, 2010, for corresponding International Patent Application PCT/US2009/063890.

*Primary Examiner* — Lee D Wilson
*Assistant Examiner* — Alvin Grant
(74) *Attorney, Agent, or Firm* — McGuireWoods LLP

(57) ABSTRACT

A pull handle for operating a window covering with a pulling lead. The pull handle includes a first element with a top end and a bottom end, and a second element, attachable to the first element, with a top end and a bottom end. When the second element is attached to the first element, the pull handle is along a section of the pulling lead with the position of the pull handle fixed with respect to the pulling lead. The pull handle is configured to have a diameter that is easily and comfortably gripped by an operator.

1 Claim, 15 Drawing Sheets

(56) References Cited

U.S. PATENT DOCUMENTS

| | | | | | |
|---|---|---|---|---|---|
| 2,660,751 | A | * | 12/1953 | Falkenberg | 16/442 |
| 2,678,688 | A | | 5/1954 | Dragon | |
| 2,681,545 | A | | 6/1954 | Hall | |
| 2,763,981 | A | | 9/1956 | Blumstein | |
| 2,857,454 | A | * | 10/1958 | Bahr | 174/138 B |
| 3,386,240 | A | | 6/1968 | Blumstein | |
| 3,452,479 | A | | 7/1969 | Bentley | |
| 3,590,519 | A | | 7/1971 | Spilhaus | |
| 3,599,704 | A | | 8/1971 | Woodle | |
| 3,768,111 | A | * | 10/1973 | Lees | 15/210.1 |
| 3,834,061 | A | * | 9/1974 | Klein | 43/44.9 |
| 3,985,037 | A | | 10/1976 | Peyser | |
| 4,192,044 | A | * | 3/1980 | Ballerini | 24/607 |
| 4,301,629 | A | * | 11/1981 | Farr | 52/99 |
| 4,611,368 | A | | 9/1986 | Battersby | |
| 4,724,883 | A | | 2/1988 | Liebowitz | |
| D294,549 | S | * | 3/1988 | Litowitz | D6/581 |
| D294,550 | S | * | 3/1988 | Litowitz | D6/581 |
| 4,967,824 | A | * | 11/1990 | Colson et al. | 160/178.1 R |
| 5,068,949 | A | * | 12/1991 | Horace | 24/115 R |
| 5,099,546 | A | * | 3/1992 | Mackal | 16/110.1 |
| 5,167,268 | A | | 12/1992 | Mao | |
| 5,238,043 | A | | 8/1993 | Woodring et al. | |
| 5,465,779 | A | | 11/1995 | Rozon | |
| 5,542,461 | A | * | 8/1996 | Huang | 160/178.1 R |
| 5,560,414 | A | * | 10/1996 | Judkins et al. | 160/178.1 R |
| 5,595,232 | A | | 1/1997 | Benthin | |
| 5,613,540 | A | * | 3/1997 | Jelic | 160/84.04 |
| 5,634,244 | A | * | 6/1997 | Fetsch et al. | 24/115 F |
| 5,689,860 | A | * | 11/1997 | Matoba et al. | 24/115 F |
| 5,715,884 | A | * | 2/1998 | Cotten | 24/115 A |
| 5,906,233 | A | * | 5/1999 | May | 160/178.1 R |
| 5,987,709 | A | * | 11/1999 | Chou | 24/116 A |
| 6,250,359 | B1 | | 6/2001 | Lorio et al. | |
| 6,289,559 | B1 | * | 9/2001 | Langer | 24/68 J |
| 6,311,756 | B1 | * | 11/2001 | Anderson et al. | 160/178.1 V |
| 6,325,132 | B1 | * | 12/2001 | Anderson et al. | 160/173 V |
| 6,390,818 | B2 | * | 5/2002 | Ferranti | 433/141 |
| 6,606,764 | B2 | * | 8/2003 | Taubner et al. | 24/116 A |
| 6,786,268 | B2 | * | 9/2004 | Corey et al. | 160/84.05 |
| 6,792,995 | B2 | * | 9/2004 | Judkins | 160/84.04 |
| 6,839,940 | B2 | * | 1/2005 | Harman | 16/110.1 |
| 6,955,208 | B2 | | 10/2005 | Kim | |
| 7,039,996 | B2 | * | 5/2006 | Crawley | 29/402.01 |
| 7,392,899 | B2 | * | 7/2008 | Pham | 206/264 |
| 7,410,076 | B2 | * | 8/2008 | Borhofen | 220/753 |
| D577,240 | S | * | 9/2008 | Francis | D6/581 |
| 7,805,813 | B1 | * | 10/2010 | Bunyard | 16/425 |
| 7,980,415 | B2 | * | 7/2011 | Crawley | 220/755 |
| 8,246,007 | B2 | * | 8/2012 | Manvel | 254/1 |
| 2002/0095743 | A1 | * | 7/2002 | Schneider et al. | 16/111.1 |
| 2004/0244921 | A1 | | 12/2004 | Kim | |
| 2005/0125955 | A1 | * | 6/2005 | Lewis | 16/426 |
| 2006/0156514 | A1 | * | 7/2006 | Lewis | 16/426 |
| 2007/0010358 | A1 | * | 1/2007 | Filice et al. | 473/513 |
| 2010/0319161 | A1 | * | 12/2010 | Manuel | 16/110.1 |

* cited by examiner

PULL HANDLE

CROSS-REFERENCE TO RELATED PATENT APPLICATION

This application claims priority to and the benefit of U.S. Provisional Patent Application No. 61/114,417, filed on Nov. 13, 2008, in the United States Patent and Trademark Office, the entire content of which is incorporated herein by reference.

FIELD OF THE INVENTION

The present invention relates to a pull handle for a window covering and other operations, and more particularly, to a pull handle for indicating pull direction.

BACKGROUND

Window coverings typically use a bead chain, pull cord, or other type of pulling lead to rotate a series of vertical or horizontal slats, or shift curtain position. By pulling on one side of the chain, the slats rotate in one direction, e.g., to the right, or the curtains open. By pulling on the other side of the chain, the slats rotate in the opposite direction, e.g., to the left, or the curtains close. Some window coverings have pull cords that are anchored to the floor or window casing so that the pull cord may be pulled up or down to operate the window covering.

However, the user has no indication as to which side of the chain or cord will perform the desired operation. The user must randomly choose one side to determine the operation performed by pulling on that side, which may not be the desired operation. The resulting undesired movement of the blinds or curtain results in user frustration and wasted time.

In addition to frustrating the operator, pulling the incorrect chain or cord introduces unnecessary wear and tear on the mechanisms of the curtain or blinds. For example, if the curtains are opened fully, a pull on the wrong cord stresses the cord and the mechanism because the curtain does not move in response to the downward pulling force.

Further, some users with limited mobility, such as people with arthritis or stroke victims, may have difficulty grasping the typically narrow bead chain or pull cord. Also, users with limited sight or users in darkened rooms may have difficulty observing the bead chain or pull cord.

SUMMARY OF THE INVENTION

An embodiment of the present invention provides a pull handle for operating a window covering with a pulling lead. The pull handle includes a first element with a top end and a bottom end, and a second element, attachable to the first element, with a top end and a bottom end. Upon attachment of the second element to the first element, the pull handle is along a section of the pulling lead with the position of the pull handle fixed with respect to the pulling lead. In an exemplary embodiment, the pull handle is configured to have a diameter that is easily and comfortably gripped by an operator.

The pulling lead may be a pull cord with at least one knot. The pull handle may further include at least one opening between the second element and the first element when the second element is attached to the first element that is large enough for the pull cord to be positioned in the opening and small enough so that the knot will not pass through the opening.

The pulling lead may be a bead chain that includes beads and connectors between the beads. The pull handle may further include at least one opening between the second element and the first element when the second element is attached to the first element that is large enough for one of the connectors to be positioned in the opening and small enough so that any one of the beads will not pass through the opening.

At least one end may include at least one opening that is large enough for one of the connectors to be positioned in the opening and small enough so that any one of the beads will not pass through the opening.

The top end and the bottom end of the pull handle may each include an opening that is large enough for one of the connectors to be positioned in the opening and small enough so that any one of the beads will not pass through the opening.

The first element and the second element may be attached with a snap-fit.

The first element and the second element may be attached with a hinge.

The first element and the second element may be made of a resilient material.

The first element and the second element may be made of a flexible material.

The pull handle may also include a covering about the first element and the second element.

The covering may be a soft non-slip material.

The pull handle may further include a directional indicator.

Another embodiment of the present invention provides a pull handle for operating a window covering with a pull cord. The pull handle includes: a first element including a cord holder, a top end, and a bottom end; and a second element, attachable to the first element, including a top end and a bottom end. Upon attachment of the second element to the first element, at least one end includes at least one opening that is large enough for the pull cord to pass through the opening. In an exemplary embodiment, the pull handle is along a section of the pull cord and is configured to have a diameter that is easily and comfortably gripped by an operator.

The cord holder may be a cleat.

The cord holder may be a clip.

The pull handle may be grip-shaped.

Another embodiment of the present invention provides a pull handle for operating a window covering with a pull chain. The pull handle includes: a first element including a top end, a bottom end, and at least one spoke, and a second element, attachable to the first element, including a top end, a bottom end, and at least one spoke receptacle. Upon attachment of the second element to the first element, at least one end includes at least one opening that is large enough for the pull chain to pass through the opening. The at least one spoke passes through at least one link of the pull chain when the first element is attached to the second element so that the position of the pull chain is fixed with respect to the pull handle. In an exemplary embodiment, the pull handle is along a section of the pull chain and is configured to have a diameter that is easily and comfortably gripped by an operator.

The spoke may attach to the spoke receptacle with a snap fit to attach the first element to the second element.

DETAILED DESCRIPTION

Figure 1:
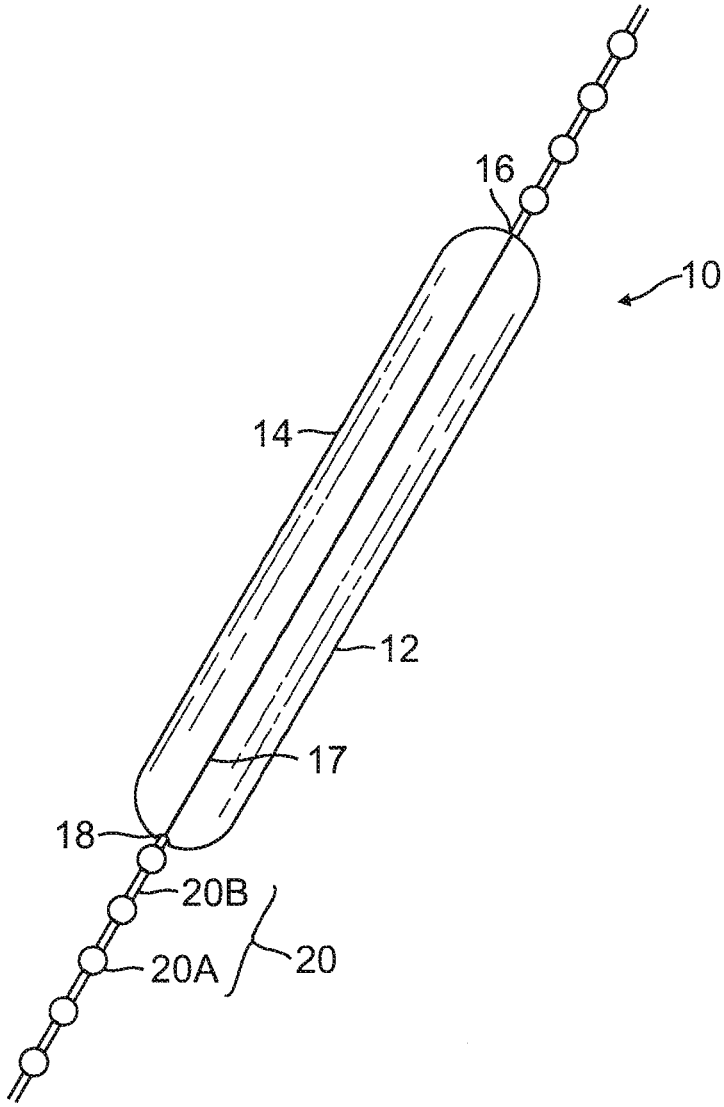
FIG. 1 is a perspective view of a pull handle according to an embodiment of the present invention.

The detailed description set forth below in connection with the drawings is intended as a description of embodiments of a pull handle provided in accordance with the present invention and is not intended to represent the only forms in which the invention may be constructed or utilized. It is to be understood that the same or equivalent functions and structures may be accomplished by different embodiments that are also intended to be encompassed within the spirit and scope of the invention. As denoted elsewhere herein, like element numbers indicate like elements or features.

As shown in FIGS. 1, 2A, 2B, and 2C, a pull handle 10 includes a first element 12 and a second element 14 that may be releasably attached at a joint 17 about a bead chain 20. In an embodiment of the present invention, the pull handle 10 is an elongated oval. The pull handle 10 may be utilized to pull the bead chain 20 to open or close a window covering, such as a horizontal or "mini" blind, vertical blinds, or curtains. A user would open or close the window covering by grasping the pull handle 10 and pulling the handle up or down to operate the bead chain 20.

The pull handle 10 may be formed of plastic, brushed or polished metal, bamboo, wood or other suitable materials, such as composites, recycled materials, silicone, or latex rubber. In other embodiments of the present invention, the pull handle may be other shapes, including, but not limited to, a tear drop, an elliptical shape, or a multi-sided shape.

The joint 17 is shown generally as the interface where the peripheral edges of the elements come together. Although this interface is shown as a straight, regular edge, it should be understood that the mating edges of the elements can have any shape that would allow them to be assembled together around the pulling lead. The edge surfaces of the elements that contact one another may also have a wide variety of mating configurations. These surfaces may be flat, which may be preferable if a releasable adhesive or magnets are used to attach the elements to one another. One surface may be inwardly curving while the opposed surface of the other element has a mating outwardly curving surface. Mating stepped surfaces and other configurations that would assist in aligning the element edges with one another and help prevent lateral movement of the elements with respect to one another once attached may also be used. As described in greater detail below, the edge surface may also be configured so as to create a snap-fit between the elements. Combinations of edge surface configurations may also be used, such as flat surfaces adjacent a hinge with a snap-fit configuration on the opposite side of the pull handle.

When the first element 12 and second element 14 are attached at joint 17, a bead chain 20 may pass through a first hole 16 at one end of the pull handle 10 and a second hole 18 at the other end of the pull handle 10, so that beads 20A are positioned on either side of each hole 16, 18, and connectors (or shanks) 20B are positioned in the holes (or openings) 16, 18. The holes 16, 18 are sized smaller than the beads 20A so that the beads 20A cannot pass through the holes 16, 18, but the connectors 20B may easily be positioned in the holes 16, 18.

The first hole 16 is formed by a notch (or opening) 16A in the first element 12 and a notch (or opening) 16B in the second element 14. Further, the second hole 18 is formed by a notch (or opening) 18A, in the first element 12 and a notch (or opening) 18B in the second element 14. For example, the notches 16A, 16B, 18A, and 18B may be semi-circular notches or other suitably shaped notches. Therefore, when the first element 12 and the second element 14 are attached at joint 17, the bead chain 20 may pass through and be releasably fixed within the pull handle 10. When a user pulls the pull handle 10 either up or down, the bead chain 20 will be pulled up or down to operate the window covering.

For example, though bead chains come in a number of different sizes, some standard sizes are listed below.

| Standard Size | Bead Diameter (inches) | Shank Diameter (inches) | Approximate Number of Beads per Foot |
|---|---|---|---|
| 3 | 3/32 | 0.020 | 102 |
| 6 | 1/8 | 0.028 | 72 |

-continued

| Standard Size | Bead Diameter (inches) | Shank Diameter (inches) | Approximate Number of Beads per Foot |
|---|---|---|---|
| 10 | 3/16 | 0.040 | 50 |
| 13 | 1/4 | 0.060 | 37 |

According to an embodiment of the present invention, the pull handle can accommodate a number of standard sized bead chains, which may be metal or plastic. Here, the diameter of the holes would be between the shank diameter of the largest bead chain, which would be 0.060 in this example, and the bead diameter of the smallest bead chain, which would be 3/32 (0.094) in this example. The holes are sized smaller than the beads so that the beads cannot pass through the holes but the shanks (or connectors) may easily be positioned in the holes. Therefore, the bead chain may pass through and be releasably fixed within the pull handle. When a user pulls the pull handle either up or down, the bead chain will be pulled up or down to operate the window covering.

Figure 2A:
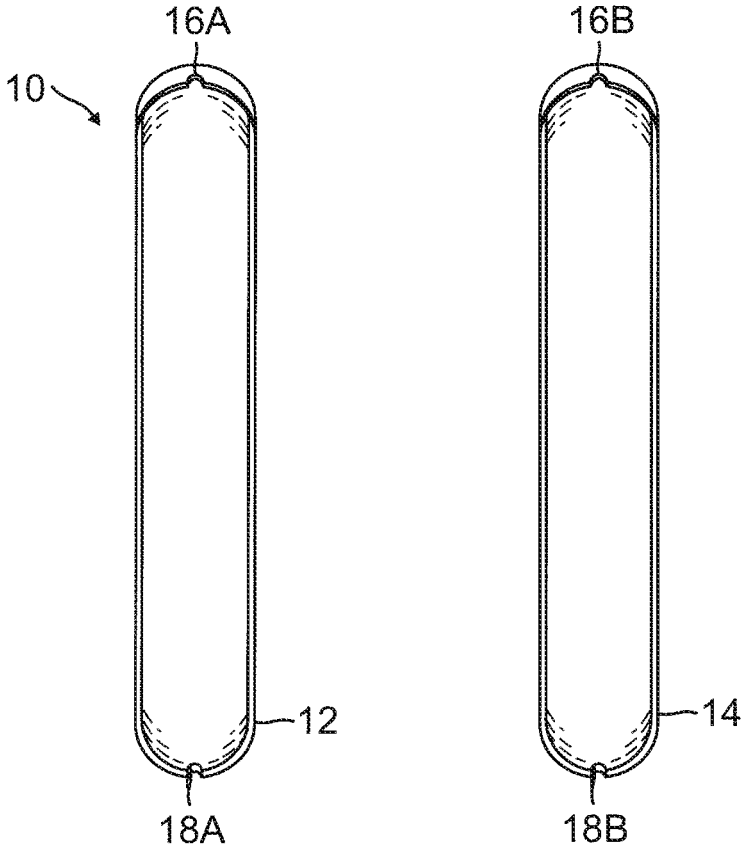
FIG. 2A is a perspective view of a disassembled pull handle according to an embodiment of the present invention.
Figure 2B:
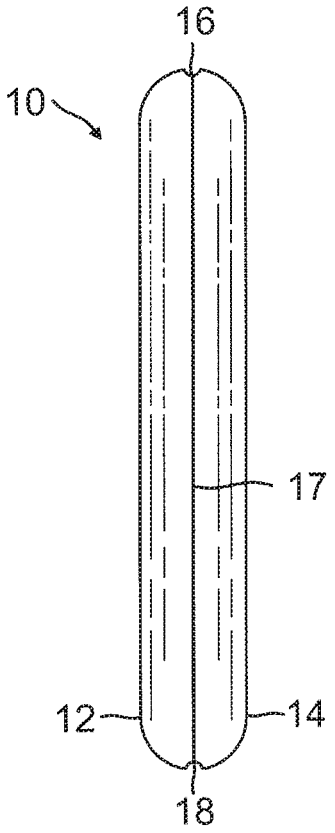
FIG. 2B is a side view of an assembled pull handle according to an embodiment of the present invention.
Figure 2C:
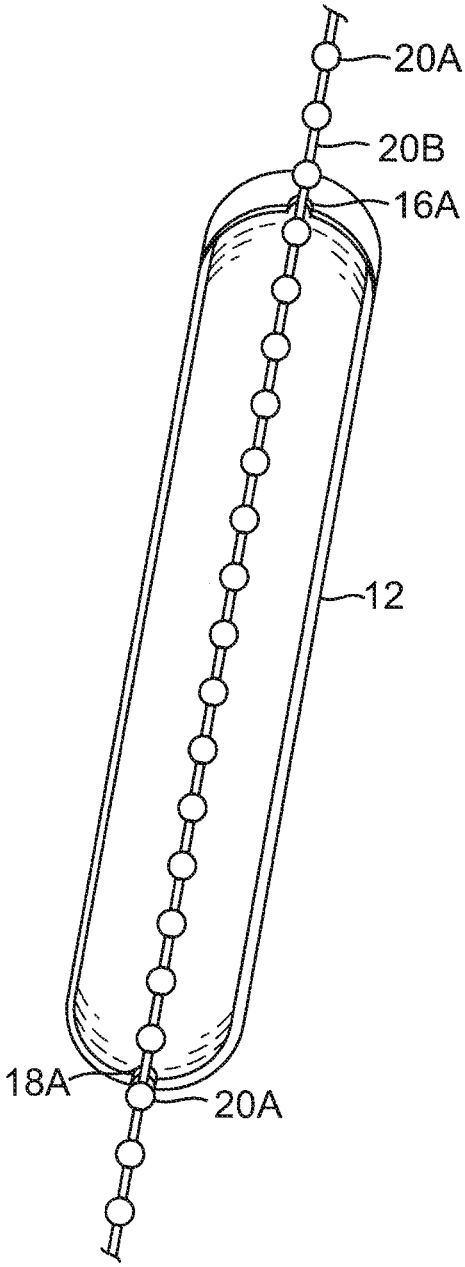
FIG. 2C is a perspective view of an element of a disassembled pull handle with a bead chain according to an embodiment of the present invention.
Figure 2D:
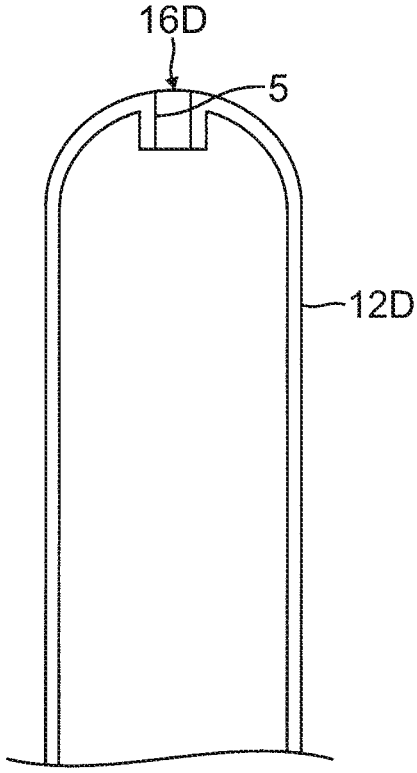
FIG. 2D is an enlarged side view of an end of a pull handle according to another embodiment of the present invention.

According to another embodiment of the present invention as shown in FIG. 2D, an opening 16D in the end of an element 12D may have a collar 5, wherein the collar is thicker than the wall of the element 12D. Here, the collar 5 has a length that is shorter than the shank of a bead chain, but long enough to reduce the distance that the shank can slide when the pull handle is pulled. The collar can also serve to strengthen the pull handle at the point where it contacts the bead chain during use.

Figure 2E:
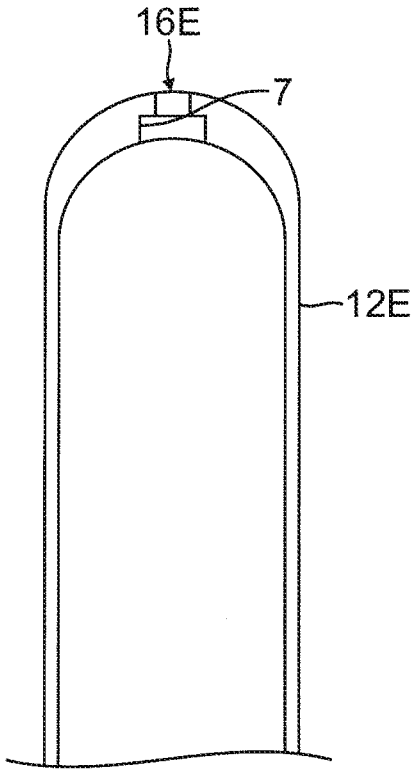
FIG. 2E is an enlarged side view of an end of a pull handle according to another embodiment of the present invention.

According to another embodiment of the present invention as shown in FIG. 2E, an opening 16E in the end of an element 12E may have an enlarged section 7 that has a diameter large enough to accommodate a bead from a bead chain. In this embodiment, the wall in the end of the element 12E is thicker than the length of a shank of a bead chain. Here, the enlarged section 7 allows the bead chain to be positioned in the opening 16E. Other configurations can also be adopted for the openings to strengthen the connection of the pull handle to the bead chain.

Figure 2F:
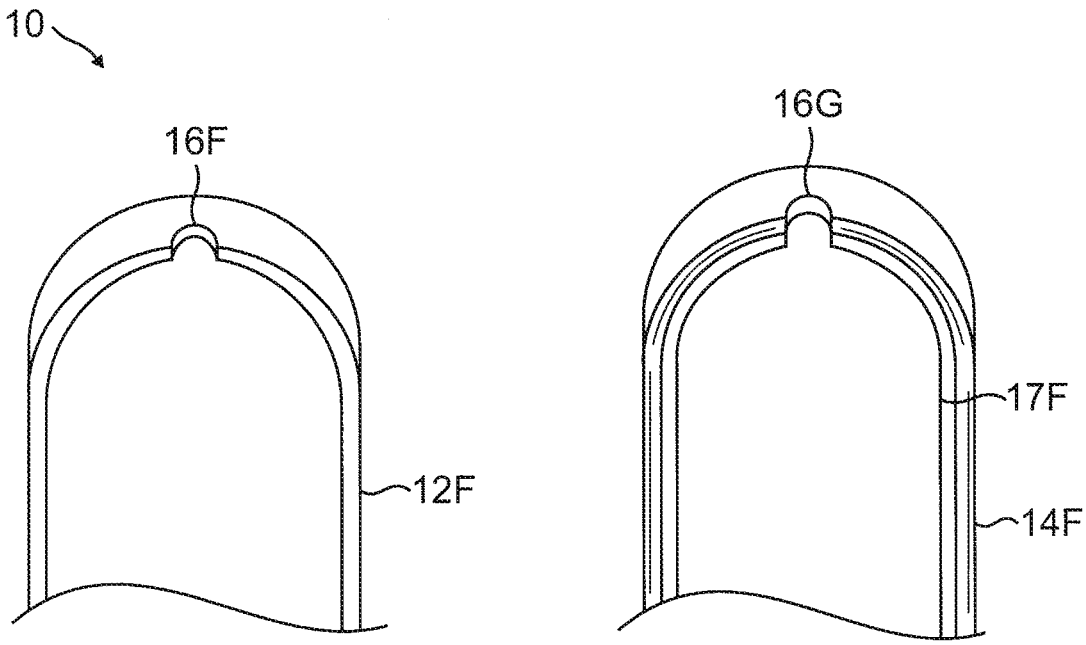
FIG. 2F is an enlarged perspective view of ends of elements of a disassembled pull handle according to another embodiment of the present invention.

According to another embodiment of the present invention as shown in FIG. 2F, an opening 16F in the end of element 12F and an opening 16G in the end of element 14F form an opening that is larger than the shank of the bead chain and smaller than the bead of the bead chain when elements 12F and 14F are assembled together. However, element 12F has a groove that is adapted to receive a ridge 17F on element 14F when the elements 12F and 14F are assembled together. Hence, the opening 16G includes an opening in both the ridge 17F and the element 14F, so that the shank of the bead chain may be positioned in the opening formed by 16F and 16G when the elements 12F and 14F are assembled together.

Figure 3:
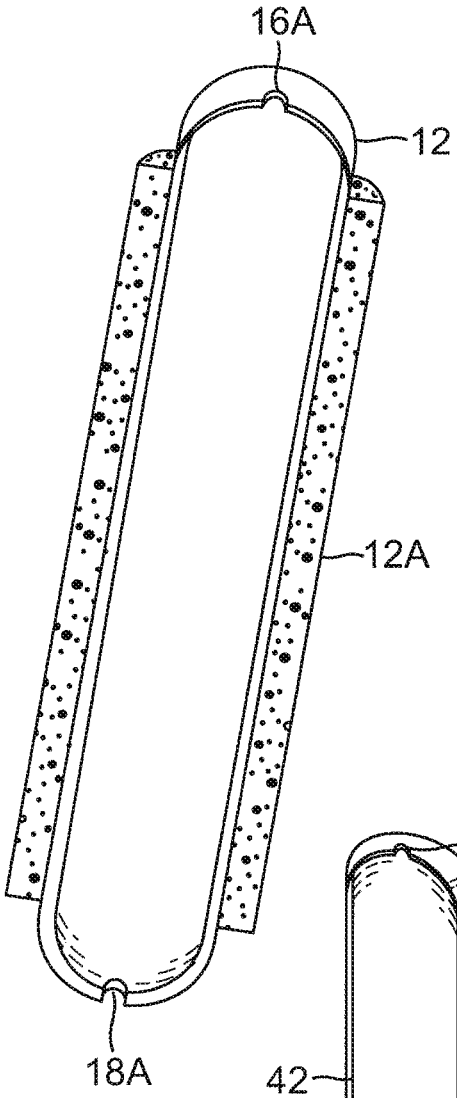
FIG. 3 is a perspective view of an element of a disassembled pull handle according to an embodiment of the present invention.

According to another embodiment of the present invention as shown in FIG. 3, a covering 12A, such as a foam, rubber, or other material, may be positioned about the pull handle. Here, the covering 12A may either be positioned about the pull handle after the pull handle is assembled, or the covering 12A may be affixed in parts to each section of the pull handle so that the covering 12A remains on the pull handle when the pull handle is disassembled. The covering material may be selected to provide a softer gripping surface or an anti-slip surface.

In an alternate embodiment, the elements of the pull handle may each be molded or formed so as to have an integral side surface facing outward that is of a different material than that desired for the body of the elements. That is, the elements may have ends and an internal core formed of a hard plastic suitable for structural integrity, while having outer side surfaces of a softer plastic that is easier to grip. Alternatively, the integral outer side surfaces of the elements may be composed of an anti-slip material. Further, the softer plastic or anti-slip material may not cover the entire outer surface of the pull handle, and may be formed in strips or other patterns on the pull handle.

In other embodiments of the present invention, the walls of the elements may be varying thicknesses. For example, the walls of the elements may be so thick that the walls press against the bead chain or other pulling lead.

Figure 4A:
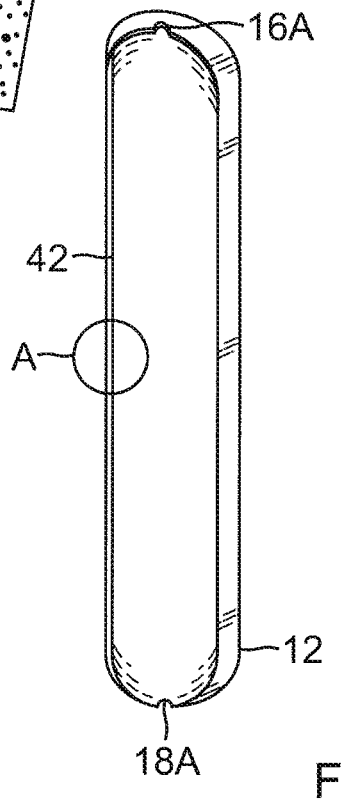
FIG. 4A is a perspective view of a disassembled pull handle according to another embodiment of the present invention.
Figure 4A:
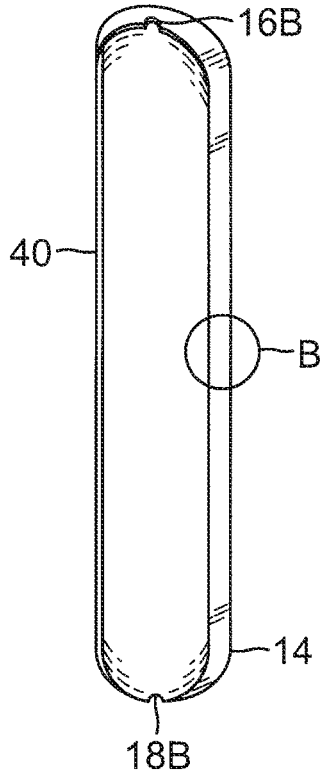
Figure 4B:
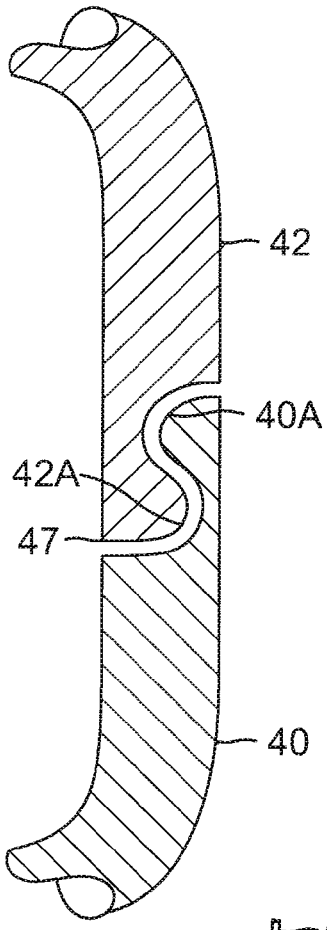
FIG. 4B is a cross-sectional view of areas A and B of FIG. 4A when assembled.

FIG. 4A shows another embodiment of the present invention, and FIG. 4B shows an enlarged cross-sectional view of areas A and B of FIG. 4A when a first element 42 and a second element 40 are attached at a joint 47. Here, the joint 47 is a snap-fit joint where a ridge 40A of the second element 40 slides past a ridge 42A of the first element 42 when the first element 42 and the second element 42 are pressed together. Once the first element 42 and the second element 40 are attached by the snap-fit joint 47, they may be separated for repositioning by pulling the first element 42 away from the second element 40 to release the joint 47. One skilled in the art will appreciate that many other types of joints, such as interference fit or other snap joints, may be utilized to attach the first element 42 to the second element 40 without departing from the spirit and scope of the invention.

In an embodiment of the present invention, the joint may include a slot to aid in the separation of the elements. For example, a coin may be inserted into the slot and twisted to force the elements apart.

Figure 4C:
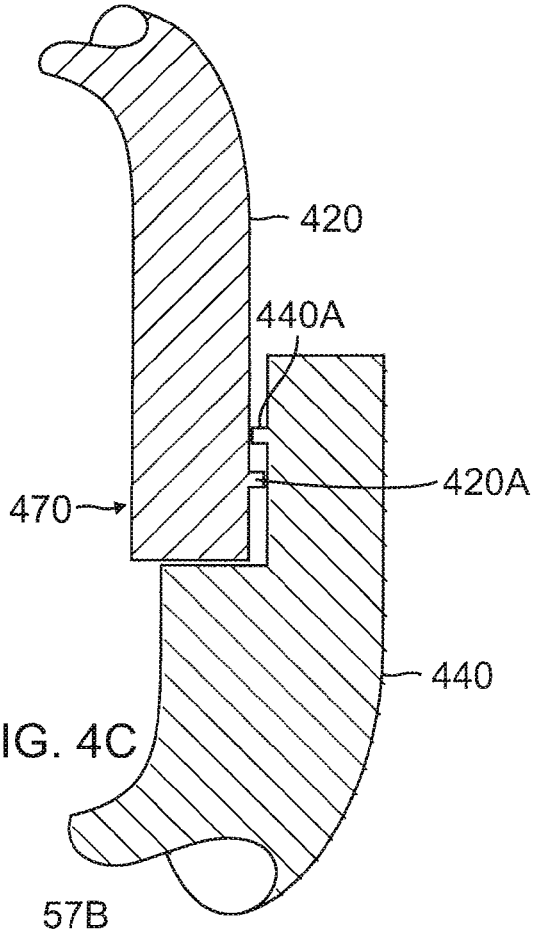
FIG. 4C is a cross-sectional view of areas A and B of FIG. 4A when assembled, according to another embodiment of the present invention.

FIG. 4C shows an enlarged cross-sectional view of a snap-fit joint according to another embodiment of the present invention. Here, a joint 470 is a snap-fit joint where a ridge 440A of a second element 440 slides past a ridge 420A of a first element 420 when the first element 420 and the second element 440 are pressed together. Once the first element 420 and the second element 440 are attached by the snap-fit joint 470, they may be separated for repositioning by pulling the first element 420 away from the second element 440 to release the joint 470.

In another embodiment of the present invention, the first and second elements may have grooves that allow them to slide with respect to one another to open and close.

Figure 6:
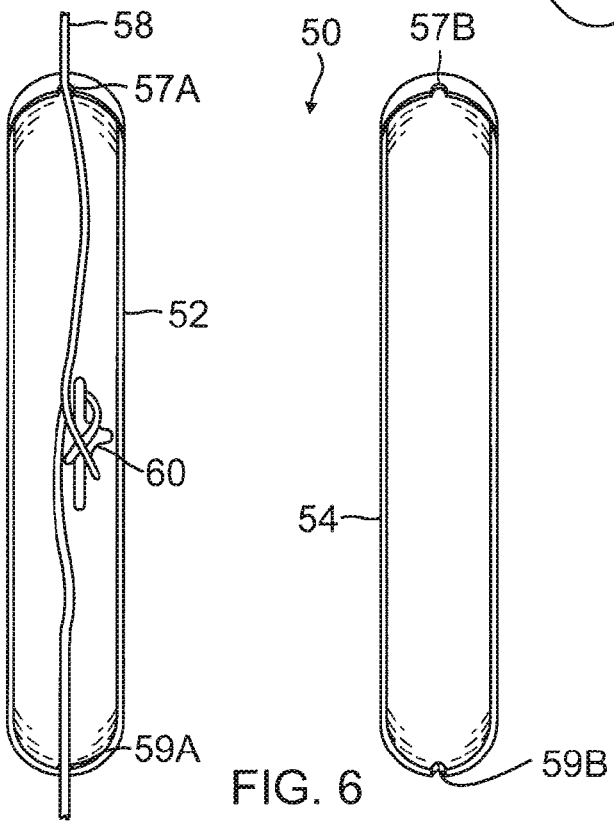
FIG. 6 is a perspective view of a disassembled pull handle according to another embodiment of the present invention.
Figure 5:
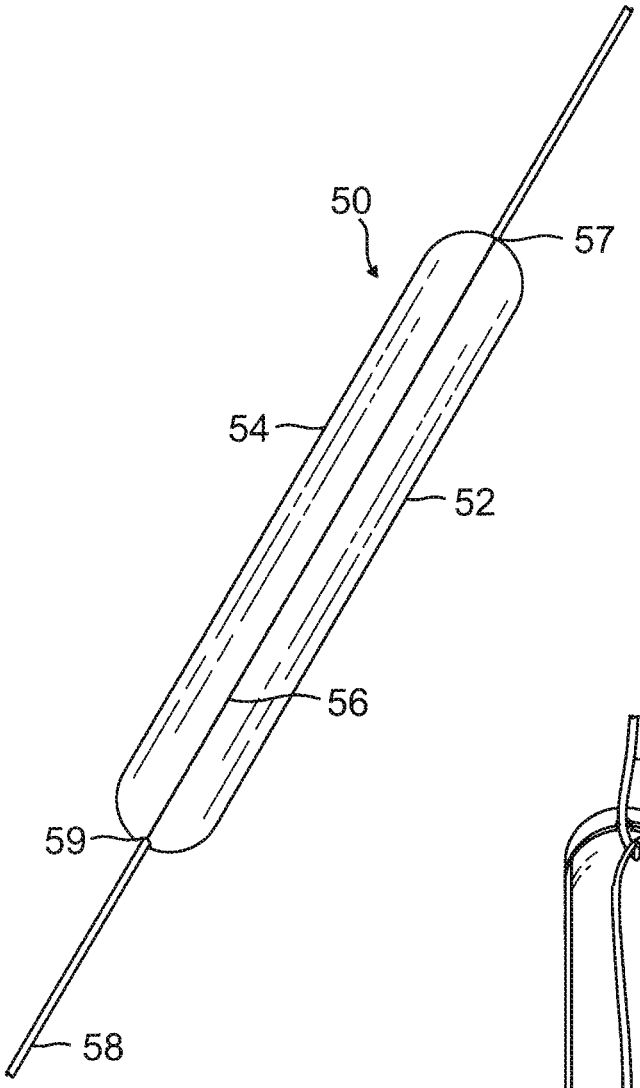
FIG. 5 is a perspective view of a pull handle and pull cord according to another embodiment of the present invention.

In another embodiment of the present invention, FIGS. 5 and 6 show a pull handle 50 for use with a pull cord 58. Here, a first element 52 and a second element 54 are releasably attached at joint 56 about the pull cord 58. The pull cord 58 may be wrapped about a cleat 60 so that the pull handle 50 remains in the same position on the pull cord 58 when the pull handle 50 is pulled to operate the window covering. The pull cord 58 extends through hole 57, formed by a notch 57A in the first element 52 and a notch 57B in the second element 54, at one end of the pull handle 50, and through hole 59, formed by a notch 59A in first element 52 and a notch 57B in second element 54, at the other end of the pull handle 50.

In another embodiment of the present invention, the cleat may be utilized as a cord keeper for child safety. In this embodiment, extra pull cord length may be wound around the cleat so that the pull cord is kept safely within the pull handle and out of reach of children that could become dangerously tangled in the cord.

Figure 6A:
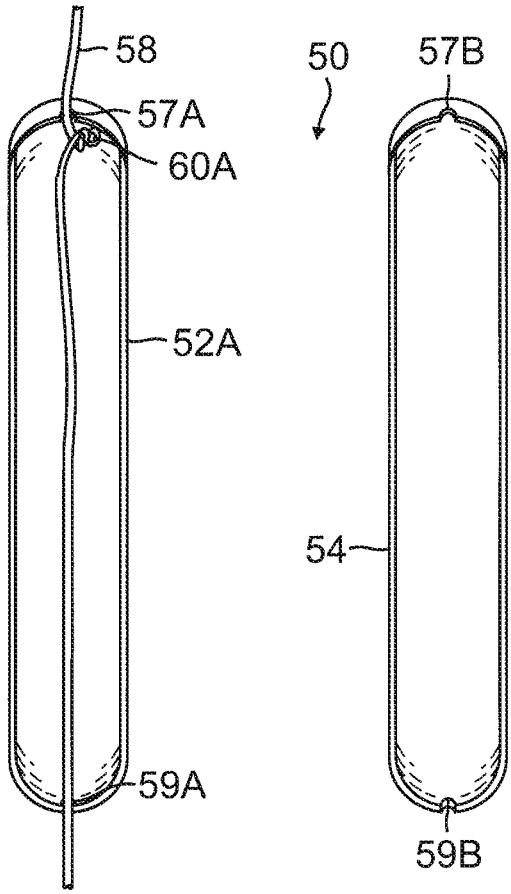
FIG. 6A is a perspective view of a disassembled pull handle according to another embodiment of the present invention.

In another embodiment of the present invention as shown in FIG. 6A, a knot 60A may be tied in the pull cord and positioned within the pull handle. Here, the knot 60A is larger than the opening formed by openings 57A and 57B and the opening formed by openings 59A and 59B when elements 52A and 54 are assembled together. Therefore, when the pull handle is pulled the knot 60A presses against either end of the pull handle to fix the position of the pull handle with respect to the pull cord.

In another embodiment of the present invention, more than one knot may be tied in the pull cord so that one knot is towards one end of the pull handle and another knot is towards another end of the pull handle. Therefore, the distance that the pull handle slides along the pull cord will be reduced when the pull handle is pulled. The knots may also be positioned along the length of the pull cord such that extra pull cord length is located between the knots. In this configuration, the extra pull cord length may then be wound up and stored within the pull handle.

Figure 9A:
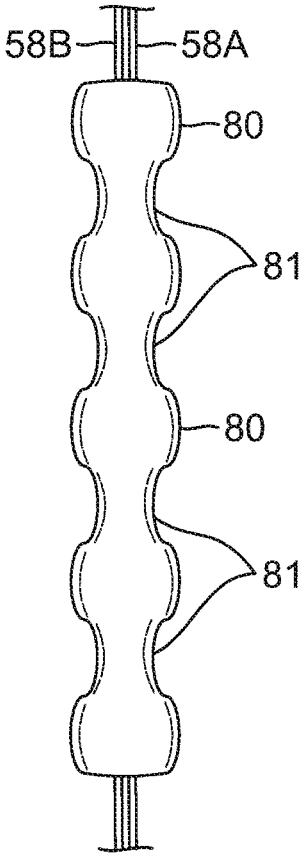
FIG. 9A is a side view of a pull handle according to another embodiment of the present invention.

In another embodiment of the present invention, more than one pull cord may be positioned in the pull handle (see FIG. 9A). Some window coverings have more than one pull cord that should be pulled together to operate the window covering. Therefore, the openings at both ends of the pull cord may be sized so that the openings are able to accommodate multiple pull cords. It should be understood, therefore, that references herein to a "pull cord" should be interpreted to mean one or more pull cords.

In another embodiment of the present invention, the openings at the ends of the pull handle are sized smaller than a pull cord clip, which holds together multiple pull cords, so that the pull cord clip will not pass through the openings when it is positioned within the assembled pull handle. Therefore, the position of the pull handle with respect to the pull cord will be fixed when the pull handle is pulled.

Figure 7:
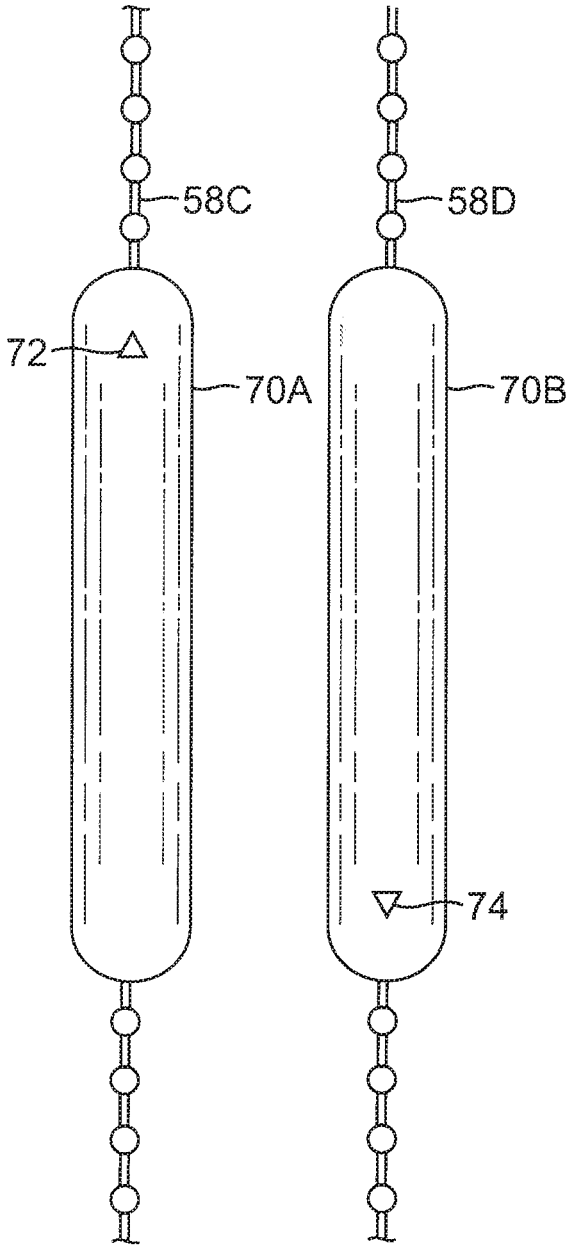
FIG. 7 is a side view of pull handles according to another embodiment of the present invention.

In another embodiment of the present invention, FIG. 7 shows a pair of pull handles 70A and 70B attached to bead chains 58C and 58D, respectively. Here, pull handle 70A is pulled to operate the window covering and has a first indicator 72, such as a phrase, arrow, ridge, or dot, to indicate to the user that the pull handle 70A should be pulled a particular direction, up or down, to operate the window covering, such as to raise a curtain. Pull handle 70B has a second indicator 74, such as a phrase, arrow, ridge, or dot, to indicate to the user that the pull handle 70B should be pulled a particular direction, up or down, to operate the window covering in the opposite manner, such as to lower a curtain. Thus, once a user ascertains which direction a pull cord should be pulled for proper operation, the pull handle can be assembled about the cord with the directional indicator pointing the proper direction.

In another embodiment of the present invention, the pair of pull handles may be similarly utilized to operate a window covering with a pull cord.

Figure 8:
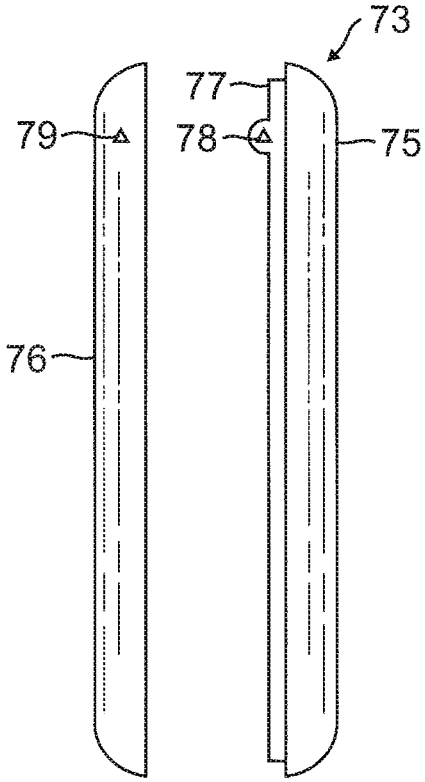
FIG. 8 is a side view of a disassembled pull handle according to another embodiment of the present invention.

In another embodiment of the present invention, FIG. 8 shows a pull handle 73 that includes a first element 75 and a second element 76. The first element 75 has a ridge 77 that fits into a groove in the second element 76. A raised portion 78 snaps into a hole 79 when the first element 75 and the second element 76 are pressed together. The raised portion 78 may be shaped in any suitable shape, such as a round shape or an arrow shape. The first element 75 and the second element 76 are held together, until the raised portion 78 is pressed out of the hole 79 to release the first element 75 from the second element 76.

In another embodiment of the present invention, the raised portion may be flush with the wall of the element when the elements are assembled together. Here, the elements may be disconnected by pressing the flush raised portion out of the hole to release the first element from the second element.

In another embodiment of the present invention, a pair of pull handles may include a light colored pull handle and a dark colored pull handle. According to this embodiment of the invention, a user should pull the light colored pull handle to open the window covering, such as to raise the curtain or rotate the blinds into an open position. A user should pull the dark colored pull handle to close the window covering, such as to lower the curtain or rotate the blinds into a closed position.

In another embodiment of the present invention, a pair of pull handles may include a sun-shaped pull handle and a crescent-moon-shaped pull handle. According to this embodiment of the invention, a user should pull the sun-shaped pull handle to open the window covering. A user should pull the moon-shaped pull handle to close the window covering.

In another embodiment of the present invention, a pull handle may have a light to dark color gradient from one end of the pull handle to the opposite end of the pull handle. For example, once the pull handle is positioned about the pull cord, the top end of the pull handle may appear to have a lighter color than the bottom end of the pull handle. Here, the pull cord may be fixed to a stationary object, such as the floor or the window casing, by threading the pull cord through a pulley or another suitable device attached to the stationary object. According to this embodiment of the invention, a user should pull the pull handle in the direction of the lighter color of the pull handle, which in this example would be pulling up, to open the curtain or blind. A user should pull the pull handle in the direction of the darker color of the pull handle, which in this example would be pulling down, to close the curtain or blind.

The pull handle may also be made of or coated by a glow-in-the-dark material. Alternatively, the opening pull handle could incorporate a light that would make it easy to see in the dark. In this way, the opening pull handle can be more easily located and used to let light into a darkened room.

In another embodiment of the present invention, the pull handle may be modified in other ways to achieve a desired appearance. For example, the pull handle may be decorated with crystals, covered with leather, or other suitable texturizing elements. Further, the pull handle may be different colors to achieve a desired appearance, or the pull handle may be formed of a clear material, such as an acrylic polymer like Lucite.

In another embodiment of the present invention, a clip, which may resemble a round paper clip, may be within the pull handle to attach a pull cord to the pull handle. In another embodiment of the present invention, one or more plastic dividers with a notch or groove may be within the pull handle, where the notch is smaller than beads of a bead chain or a knot tied in a pull cord so that the bead chain or pull cord may be positioned within the notch or notches and secured within the pull handle.

In another embodiment of the present invention, FIG. 9A shows an ergonomically shaped pull handle 80 about the pull cord 58. Here, the pull handle 80 is shaped so that it is easy and comfortable to grip. The pull handle 80 has indentations 81 for the fingers of the user to rest comfortably within when the user is gripping the pull handle 80. In another embodiment of the present invention as shown in FIG. 9A, the pull handle may be adapted to be about more than one pull cord, such as two pull cords 58A and 58B, since some window coverings have multiple pull cords that should be pulled together to operate the window covering.

A person of ordinary skilled in the art will appreciate that the pull handle may be formed into numerous different shapes that would be suitable for different applications. For example, the pull handle may be shaped like a dumbbell, a sphere, a football, or animal or action figure shapes.

Figure 9B:
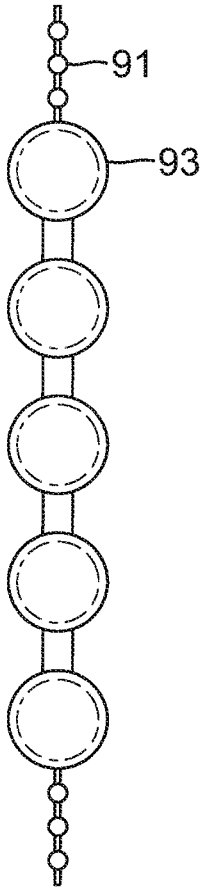
FIG. 9B is a side view of a pull handle according to another embodiment of the present invention.
Figure 9C:
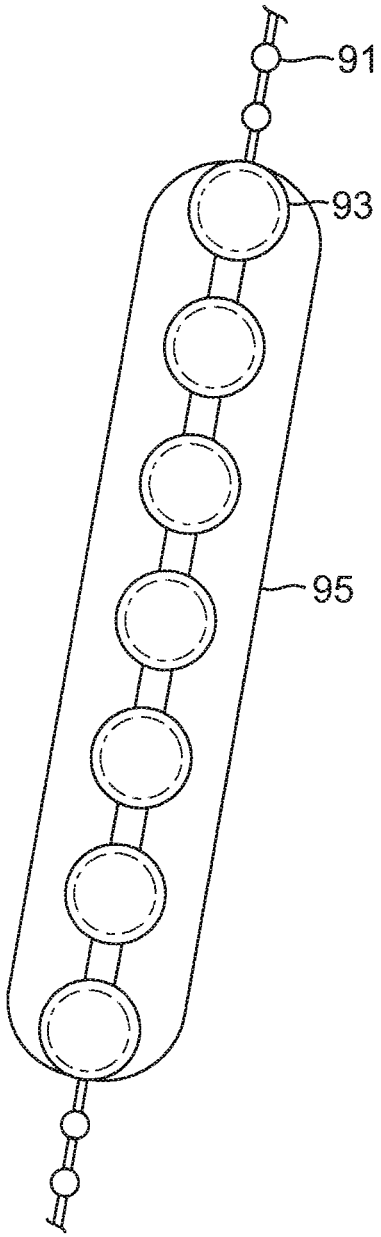
FIG. 9C is a side view of a pull handle according to another embodiment of the present invention.

For example, as shown in FIG. 9B, the pull handle 93 may be shaped like an enlarged bead chain, and may be positioned about a bead chain 91. In another example shown in FIG. 9C, an outer shell 95 formed of a clear material, such as plastic, may be positioned about the pull handle 93. The clear material may be a hard plastic or it may be a flexible plastic. The clear material may also incorporate decorative elements such as a colored dye or sparkles.

Figure 10:
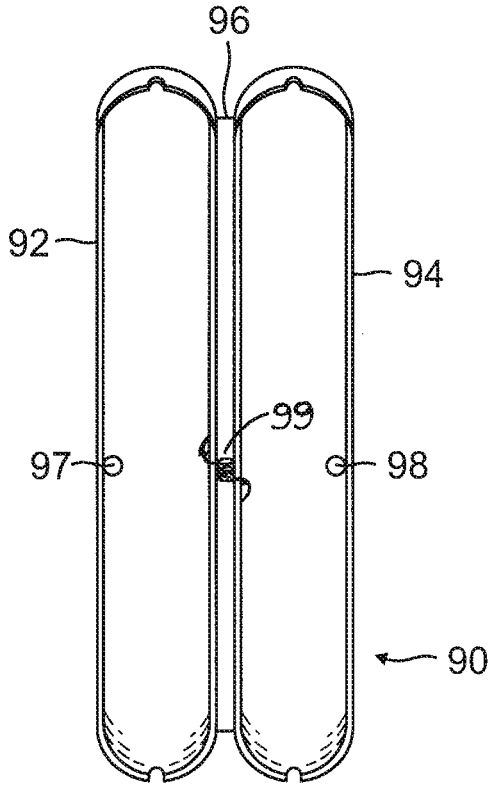
FIG. 10 is a perspective view of a pull handle according to another embodiment of the present invention.

In another embodiment of the present invention, FIG. 10 shows a pull handle 90 that includes a first element 92, a second element 94, and a hinge 96 that attaches the first element 92 to the second element 94 along one side of each. For example, the hinge 96 may be a strip of flexible plastic which is fused to the first element 92 and the second element 94 and allows them to be closed and opened about a pull cord or bead chain. One skilled in the art will appreciate that many different types of hinges may be utilized without departing from the spirit or scope of the invention.

As also shown in FIG. 10, a spring 99 may be provided that acts to bias the elements 92 and 94 toward a closed position about hinge 96. In this embodiment, the spring-loaded pull handle clamps about the pulling lead. The edge of the elements opposite the hinge may come together in a simple abutting manner or may be otherwise configured to connect to one another. Spring 99 is shown as a coil spring. However, it should be understood that any means for biasing the elements toward a closed position may be used. For example, the hinge may inherently act as a biasing means.

In another embodiment of the present invention, a first element and a second element may be held together in the closed position with magnets 97, 98 located on the first and second elements 92, 94, respectively (see FIG. 10). The magnets may be located within the walls of the elements, on the walls of the elements, or along the walls of the elements. Further, any suitable number of magnets may be utilized. The magnets may be used in conjunction with a spring to assist in holding the elements closed. However, magnets may also be used by themselves without a hinge and/or a spring.

In other embodiments of the present invention, the pull handle shape may be suitably modified for particular users. For example, the pull handle can be made thicker, so that users with arthritis in their hands may more comfortably grip the pull handle. In another example, the pull handle may have a loop so that users with limited mobility may more easily operate the pull handle, such as by using a hook.

In another embodiment of the present invention, the pull handle may be adapted for use in industrial applications, such as for operating warehouse doors or manufacturing machinery. For example, a pair of pull handles, with one pull handle being green and the other pull handle being red, may be used for a pull chain for a warehouse door, so that pulling the green pull handle opens the door and pulling the red handle closes the door. In another example, pulling the green handle may start a piece of machinery and pulling the red handle may stop a piece of machinery.

In another embodiment of the present invention, the pull handle may be colored red to indicate that it may be used in an emergency situation, such as an emergency chemical shower.

In another embodiment of the present invention, the pull handle may be formed of a material, such as Kevlar or Gortex, that provides insulation where the pull cord or bead chain may be too hot or too cold to touch. For example, in another embodiment of the present invention, the pull handle may be utilized on snow chains for tires.

In another embodiment of the present invention, the pull handle may be illuminated, such as with an LED light or other suitable light source, or reflective for situations where light or reflections may be desired.

Figure 11:
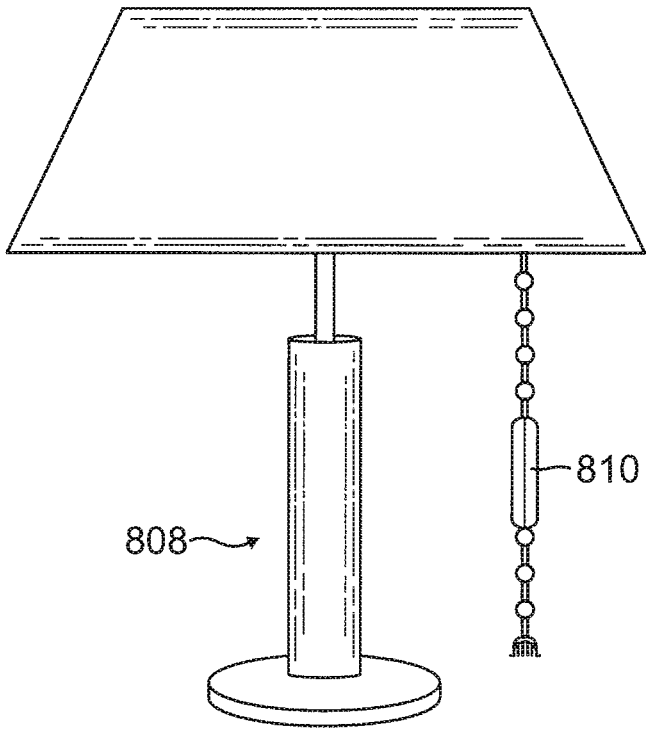
FIG. 11 is a perspective view of a pull handle according to another embodiment of the present invention.

In another embodiment of the present invention, the pull handle 810 may be utilized to add weight to a pull cord or a bead chain, such as a pull cord for lamps 808, as shown in FIG. 11, or ceiling fans. Further, the pull handle may be adapted or shaped to make desired sections of a pull cord or a bead chain rigid.

Figure 12:
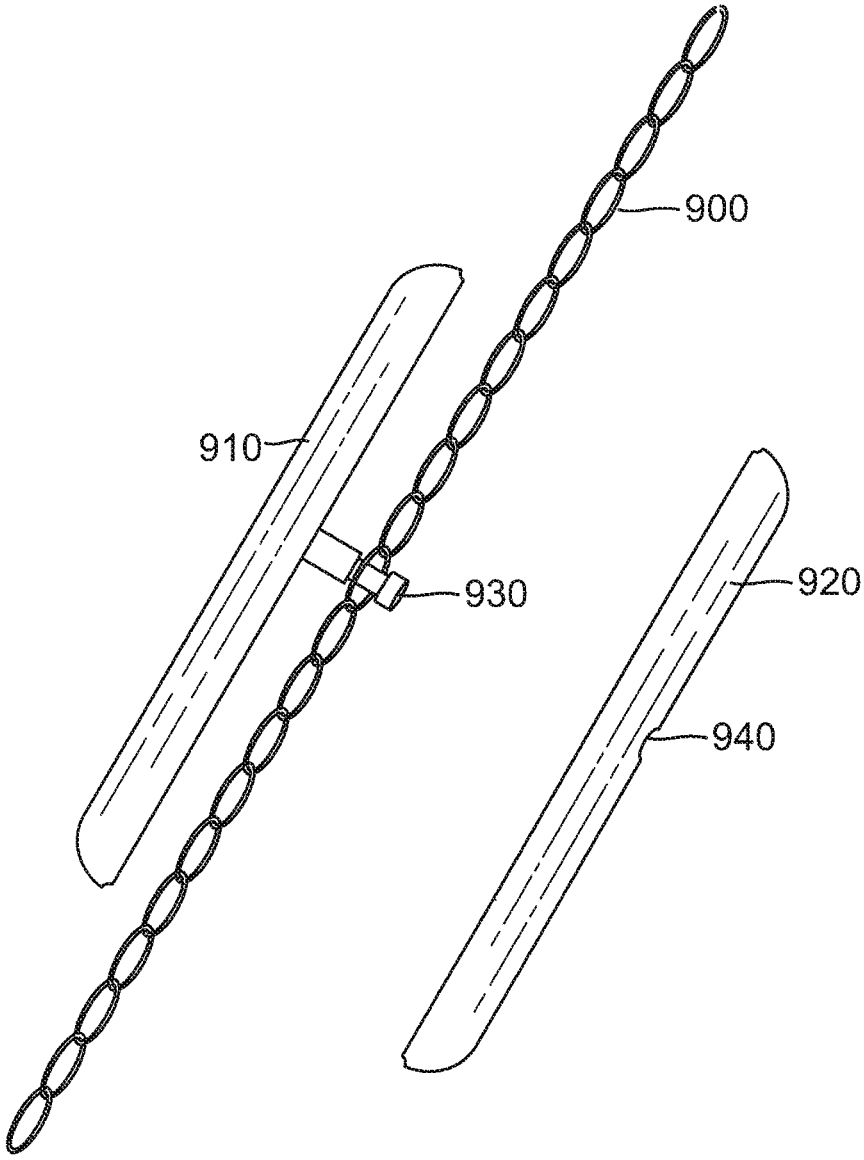
FIG. 12 is a perspective view of a disassembled pull handle according to another embodiment of the present invention.

In another embodiment of the present invention shown in FIG. 12, the pull handle 910 may be utilized to operate a pull chain 900. For example, the pull handle 910 may be placed about the pull chain 900, and the pull handle 910 may then be pulled to operate a device utilizing a pull chain 900, such as a garage door or a telescoping ladder. Here, a pull chain 900 may be positioned in a first element 910 so that a link of the chain 900 is about a spoke 930. When the first element 910 is attached to a second element 920, the spoke 930 snaps into a hole 940 to hold the first element 910 and the second elements 920 together.

Figure 13:
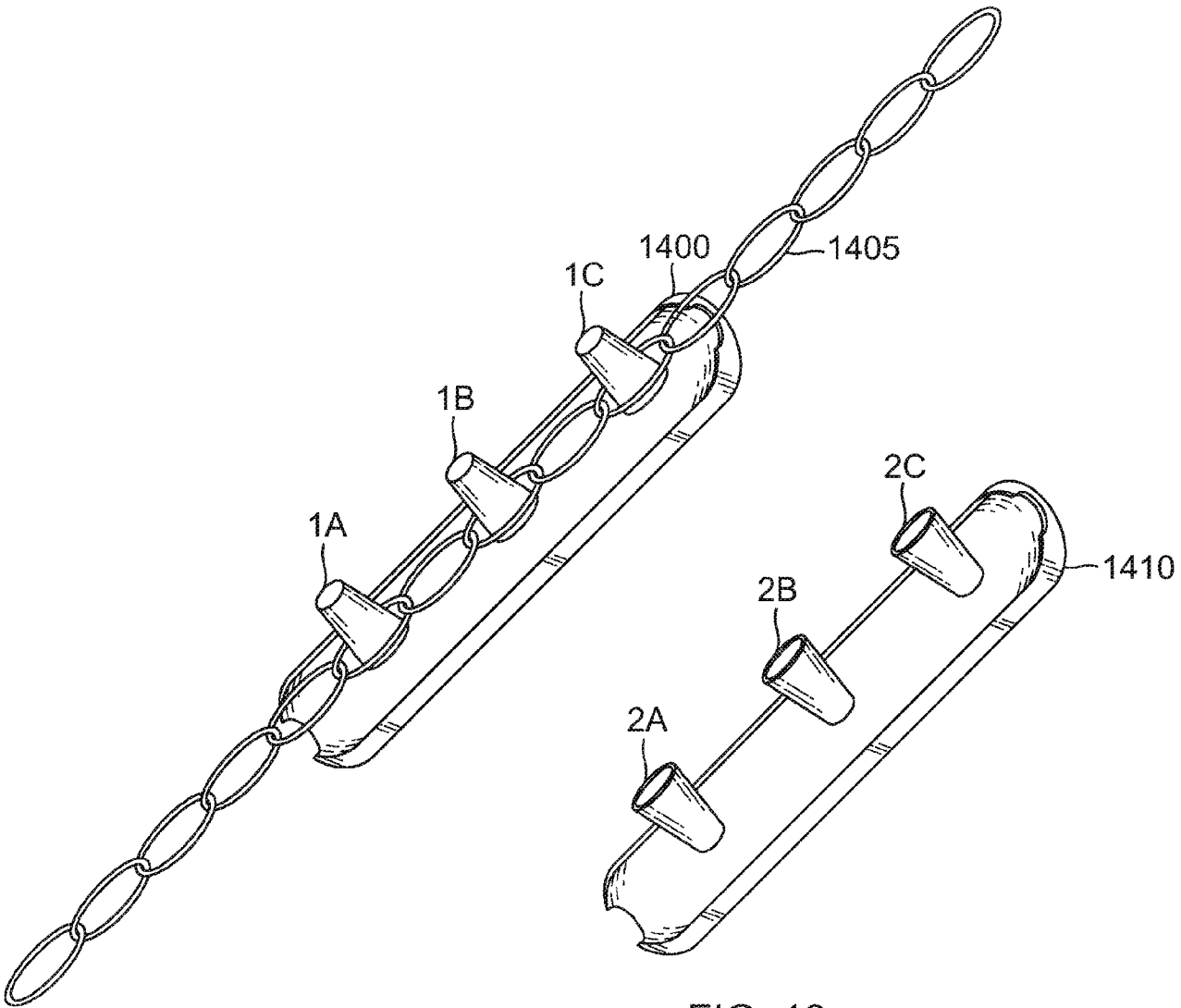
FIG. 13 is a perspective view of a disassembled pull handle according to another embodiment of the present invention.

In another embodiment of the present invention shown in FIG. 13, a first element 1400 has spokes 1A, 1B, and 1C that are positioned through links of the pull chain 1405 and into hollow tube-like spoke receivers 2A, 2B, and 2C in a second element 1410 so that the chain 1405 is held in position relative to the pull handle.

Figure 14A:
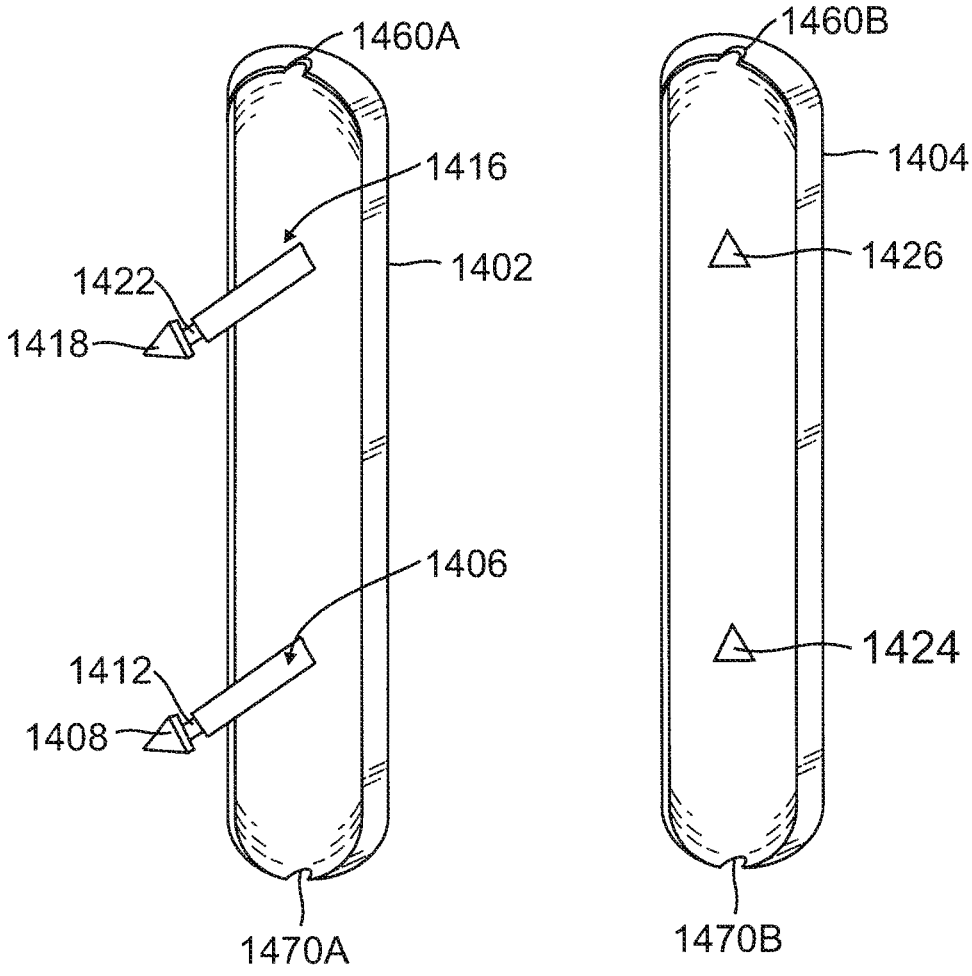
FIG. 14A is a perspective view of a disassembled pull handle according to another embodiment of the present invention.
Figure 14B:
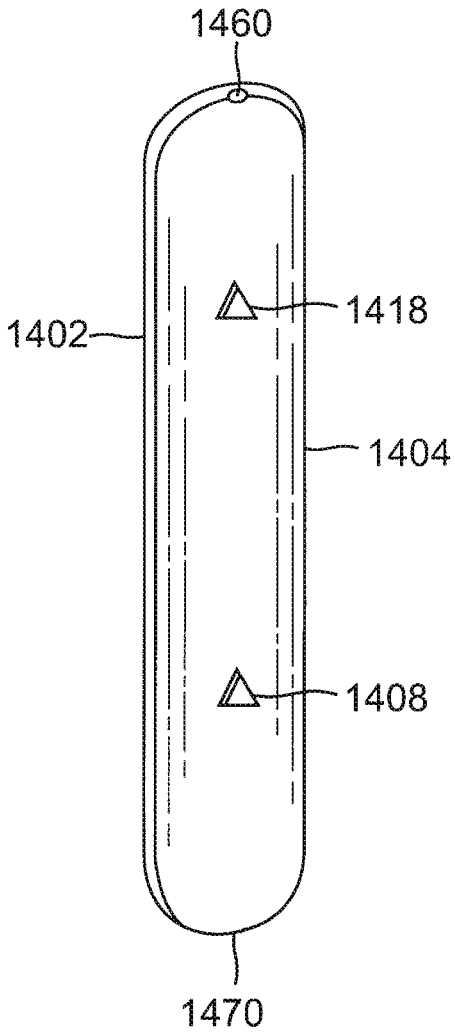
FIG. 14B is a perspective view of the pull handle of FIG. 14A assembled.

In another embodiment of the present invention shown in FIGS. 14A and 14B, a pull cord or bead chain may be positioned in a first element 1402. If a pull cord is utilized, the pull cord may be wrapped about spokes 1416 and 1406 so that the position of the pull handle relative to the pull cord is fixed. When the first element 1402 is attached to a second element 1404, buttons 1418 and 1408 on spokes 1416 and 1406 snap into holes 1426 and 1424, respectively, to hold the first element 1402 and the second element 1404 together. Here, two spokes are shown, but other embodiments may have other numbers of spokes. Once the buttons 1418 and 1408 are snapped through the holes 1426 and 1424, posts 1422 and 1412 are positioned in the holes 1426 and 1424, respectively. The pull cord or bead chain is positioned in a first opening 1460, formed by notches 1460A and 1460B, and a second opening 1470, formed by notches 1470A and 1470B. To release the pull cord or bead chain, the buttons 1418 and 1408 are pressed back through holes 1426 and 1424 to separate the first element 1402 from the second element 1404.

In the embodiment shown in FIGS. 14A and 14B, the posts are triangular in cross section so that they can also serve as a directional indicator for the pull handle by virtue of the externally visible buttons when the pull handle is assembled. Thus, once a user has ascertained which way a pull chain should be pulled for the desired operation, the pull handle can be assembled about the chain with the triangular arrows pointing in the appropriate direction.

In another embodiment of the present invention, the posts and buttons may be shapes other than triangles, such as circles, square, or ovals. Further, the buttons may also be different colors. For example, one button may be a light color and the other button may be a dark color.

In another embodiment of the present invention, the buttons, which are shown as being raised above the external element wall, may be flush with the element wall.

In other embodiments of the present invention, the pull handle may be formed of multiple materials. For example, the pull handle may be formed of a hard plastic and may have sections, such as grip strips, that are formed of a rubber material for ease of gripping the pull handle. In another example, the pull handle may be formed of a magnetized metal that is polarized so that one element of the pull handle will be attracted to the other element of the pull handle to hold the pull handle together about a pull cord or bead chain.

In another embodiment of the present invention, one element may have posts on the walls of the element that fit into posts on the walls of the other element so that the elements are held together about a pull cord or bead chain.

Although the present invention has been described through the use of exemplary embodiments, it will be appreciated by those of skill in the art that various modifications may be made to the described embodiments that fall within the scope and spirit of the invention as defined by the claims and their equivalents appended hereto. For example, aspects shown above with particular embodiments may be combined with or incorporated into other embodiments. Therefore, the pull handle may be adapted to be utilized with any pull cord or bead chain to provide the features desired.

What is claimed is:

1. A pull handle for operating a window covering with a pulling lead, comprising: a first element with a top end and a bottom end and a notch at each end, and a second element with a top end and a bottom end and a notch at each end; wherein the first element is attachable to the second element at a selected position to the pulling lead with the notches of the first element juxtaposed with the notches of the second element such that a section of the pulling lead is fixed between the respective top and bottom ends of the first element and the second element and extends through the juxtaposed notches at the respective top and bottom ends of the first element and the second element, the first element and the second element when attached having a length between the respective top and bottom ends of the first element and the second element and a diameter providing an outer circumference configured to be easily and comfortably gripped by an operator, wherein the first element and the second element are attached with a hinge, and further comprising a spring element for biasing the first element and the second element toward a closed position; wherein, when the second element is attached to the first element, the pull handle is along the section of the pulling lead with the position of the first element and the second element of the pull handle fixed with respect to the pulling lead and the pull handle is configured to be easily and comfortably gripped by the operator to operate the window covering, wherein the pulling lead comprises a bead chain comprising beads and connectors between the beads; and the pull handle further comprises at least one opening between the second element and the first element when the second element is attached to the first element that is large enough for one of the connectors to be positioned in the opening and small enough so that any one of the beads will not pass through the opening.

* * * * *